US006164788A

United States Patent [19]

Gemmell et al.

[11] Patent Number: 6,164,788

[45] Date of Patent: Dec. 26, 2000

[54] DROP DOWN EMERGENCY LIGHTING UNIT

[76] Inventors: Thomas Gemmell, 80 Roy Drive, Mississauga, Ontario, Canada, L5M 1A7; Abi Madadi, 21 Winter Gardens Trail, Scarborough, Ontario, Canada, M1C 3M8

[21] Appl. No.: 09/184,452

[22] Filed: Nov. 2, 1998

[51] Int. Cl.[7] ..... F21V 19/04

[52] U.S. Cl. ..... 362/20; 362/250; 362/286; 362/288; 362/386

[58] Field of Search ..... 362/20, 286, 288, 362/386

[56] References Cited

U.S. PATENT DOCUMENTS 4,802,065 1/1989 Mitner ..... 362/20

5,025,349 6/1991 Gow .

*Primary Examiner*—Sandra O'Shea
*Assistant Examiner*—Anabel Ton

[57] ABSTRACT

A drop down concealed emergency lighting unit includes a box-like housing for substantially flush mounting in a recess and a pivotally mounted door for closing the opening in the housing and upon which is mounted a lamp unit. A drive assembly moves the door between the open and closed positions and includes a DC motor on the housing with a drive gear which is operatively engageable with a driven gear on the door to move the door to the closed position. An electrical control circuit senses the absence of alternating current and effects disengagement of the gears to allow the door to move from the closed position to the open position, and senses the restoration of alternating current to effect reengagement of the gears to actuate the motor to move the door to the closed position.

18 Claims, 11 Drawing Sheets

DROP DOWN EMERGENCY LIGHTING UNIT

BACKGROUND OF THE INVENTION

The present invention relates to emergency lighting units, and, more particularly, to such lighting units which may be substantially concealed in a building surface.

Emergency lighting units are widely employed in commercial and industrial buildings to provide illumination in the event of failure of normal power. Such units employ lamps which are oriented to illuminate passages to exits and are powered by direct current obtained either from internal batteries or from a decent conduit connected to a central battery bank. During normal power conditions, the batteries are charged by a charging circuit.

Such emergency lighting units are generally surface mounted and, despite substantial design efforts, detract from the otherwise planar surface characteristics of the rooms in which they are mounted. Since they are exposed, they are subject to environmental conditions and can be damaged by vandals or by accident as a result of operations within the rooms in which they are placed.

In an effort to improve the physical appearance of the rooms in which placed and to minimize the opportunity for injury to the emergency lighting units, there has been interest in providing units which could be concealed in the ceiling and only moved into an operative position in the event of a failure of the AC power supply. Attempts to produce such structures are illustrated in Gow U.S. Pat. No. 5,025,349 granted on Jun. 18, 1991 and Minter et al U.S. Pat. No. 4,802,065 granted on Jan. 31, 1989.

Units which require a substantial amount of energy to effect their movement from the concealed position to the operative position present the potential for malfunction, and could result in a possible hazard if the lamps were to be illuminated while still in their concealed or unexposed condition. Moreover, any obstruction impeding the opening movement could result in substantial damage to the drive assembly.

Accordingly, it is an object of the present invention to provide a novel concealed emergency lighting unit which will drop down to the open or functioning position, principally under the force of gravity.

It is also an object to provide such an emergency lighting unit which can be fabricated relatively easily from components which themselves can be readily fabricated or purchased.

Another object is to provide such a lighting unit which is attractive and which is readily adapted to use either with internal battery power or with DC current from an external battery supply.

SUMMARY OF THE INVENTION

It has now been found that the foregoing and related objects may be readily attained in a drop down concealed emergency lighting unit including a housing for substantially flush mounting in a recess formed in a building surface, and providing an opening extending in a plane to be oriented adjacent and parallel to the building surface. One end of a door for closing the opening is pivotably mounted on the housing for movement relative thereto between a closed position overlying the opening and a second open position in which the door extends substantially perpendicularly to the plane of the opening.

A drive assembly for moving the door between the open position and the closed position includes a direct current drive motor which is mounted on the housing and which as a output shaft and drive gear is mounted on the output shaft. A driven gear is mounted on the door, and the assembly includes means operatively engaging the drive and driven gears for movement of the door to the closed position and for maintaining the door in the closed position.

A lamp unit powered by direct current is also mounted on the door.

Within the housing is an electrical control circuit which is adapted to be connected to sources of alternating current and of direct current. It is connected to the motor and the lamp unit, and includes a rectifier to convert alternating current to direct current for supply to the motor. There is also included means for sensing the absence of alternating current and for effecting disengagement of the gear operatively engaging means, to allow the door to move from the closed position to the open position. The circuit provides power to the lamp unit upon the absence of alternating current and movement of the door to the open position. Means for sensing the restoration of alternating current acts to effect reengagement of the gear operatively engaging means and to supply direct current to the motor to move the door to the closed position. The control circuit further acts to terminate flow of direct current to the lamp upon movement of the door to the closed position.

Desirably, the gear operatively engaging means is provided by a drive gear having an untoothed sector in which the driven gear is released from engagement therewith. The rotation of the motor to effect movement of the door to the closed position causes the drive gear to move to a position adjacent the untoothed sector at which the drive and driven gears remain engaged to retain the door in the closed position.

Preferably, the drive gear has a toothed sector of a length sufficient to move the door to the closed position and an additional tooth to maintain engagement with the driven gear to retain the door in the closed position. Generally, the drive assembly includes an intermediate gear between the drive and driven gears.

In its preferred form, the control circuit, upon sensing the absence of alternating current, provides only a short pulse of power to the motor to effect rotation of the drive gear to the untoothed sector. The assembly also includes biasing means acting upon the door to bias it to the open position, and a pair of lamp units on the door.

Generally, the driven gear is mounted on a support shaft which is fixedly supported on the door and pivotably supported in the housing. A clutch is drivingly mounted on the support shaft and the driven gear is drivingly engaged with the support shaft therethrough. The clutch is effective to disengage the driven gear from the support shaft in the event of forces acting upon the door to prevent closing movement. The assembly also includes a switch actuated by movement of the door to the open position to provide power to the lamp unit, and movement of the door to the closed position to terminate operation of the motor and to discontinue flow of current to the lamp unit.

DETAILED DESCRIPTION OF THE PREFERRED EMBODIMENT

Figure 1:
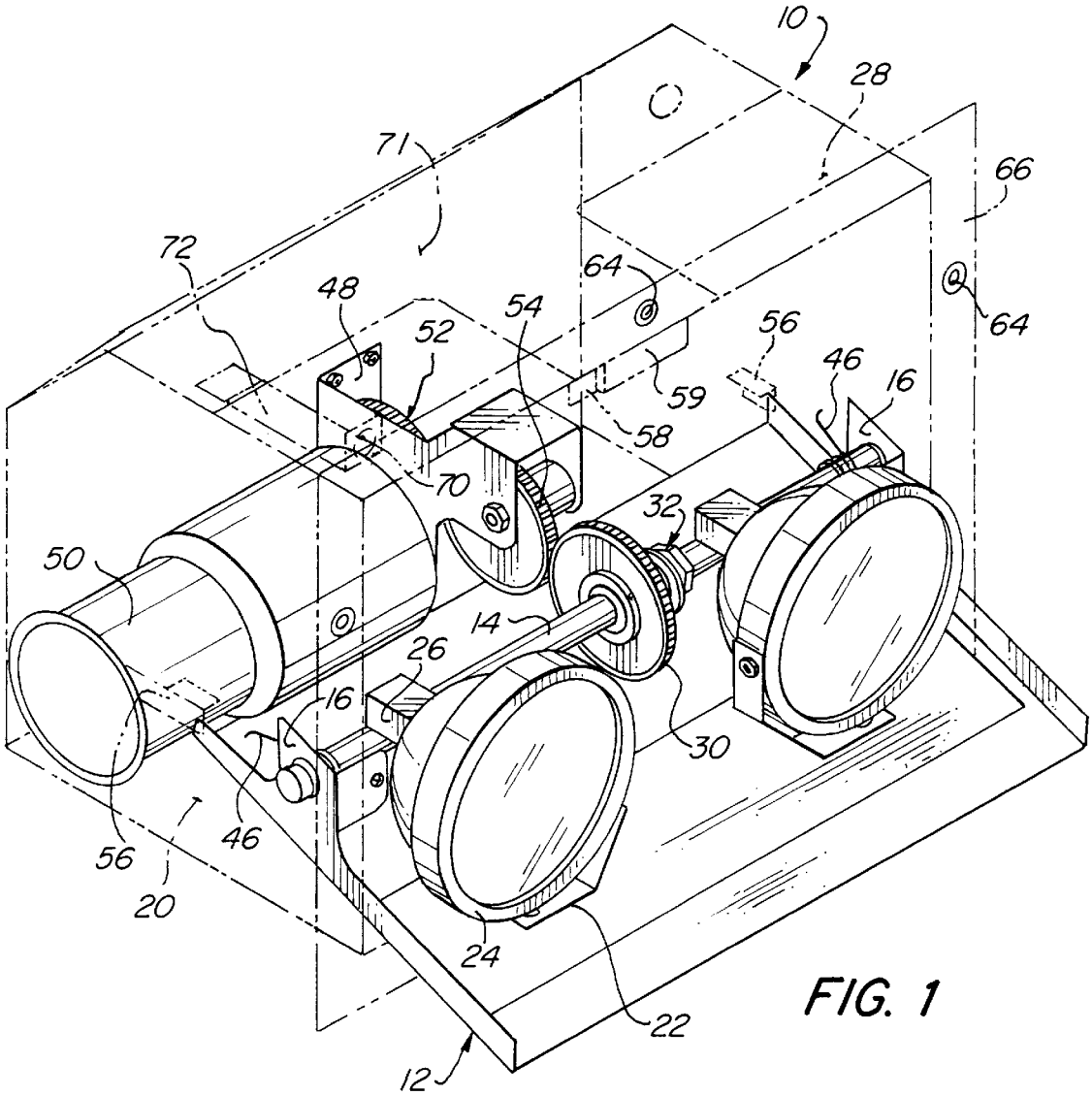
FIG. 1 is a perspective view of an emergency lighting unit embodying the present invention with the door pivoted into the open position and with the housing shown in phantom line.

Turning first to FIG. 1, therein illustrated is a lamp unit embodying the present invention with a box-like housing shown in phantom line and generally designated by the numeral 10 and a door generally designated by the numeral 12 which will close the opening of the housing 10. The door 12 is pivotally mounted on the housing 10 by the support shaft 14 which is seated in the brackets 16 at the sides of the door 12 and which is journalled in apertures in the side walls 20 of the housing 10.

Also mounted on the door 12 are a pair of gimbal brackets 22 which adjustably support the lamp units 24. Power is supplied to the sockets 26 thereof by conductors (not shown) from the control circuit board 28 mounted in the upper portion of the housing 10.

Figure 2:
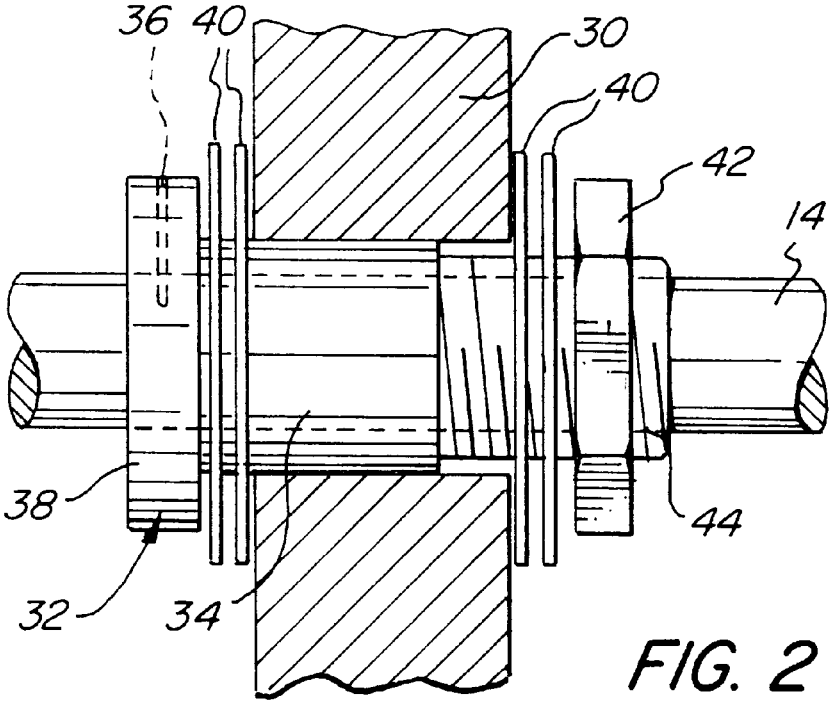
FIG. 2 is an elevational view of the clutch drawn to an enlarged scale.

Mounted on the support shaft 14 is a relatively large diameter pinion gear 30 which is mounted on the clutch assembly generally designated by the numeral 32. As seen in FIG. 2, the clutch assembly 32 has a body 34 upon which is mounted the gear 30. A pin 36 extending through the stop portion 38 locks the body 34 onto the support shaft 14, and the spring washers 40 press the gear 30 against the stop portion 38. The nut 42 is adjustably threaded onto the sleeve 44 and can be loosened or tightened to increase or decrease the frictional force between the gear 30 and stop portion 38.

Also mounted on the support shaft 14 at its ends are coil springs 46 which act against the housing 10 to bias the door 12 to its open position.

Supported on the housing 10 is a bracket 48 upon which is mounted the DC motor 50 which has a drive or output shaft (not shown) upon which is mounted the drive pinion gear 52. The bracket 48 also rotatably supports the intermediate or transfer pinion gear 54 which meshes with both the drive gear 52 and driven gear 30 to provide the drive connection for closing movement of the door 12. Power to the motor 50 is provided by conductors (not shown) from the control circuit board 28.

Mounted on the side walls 20 of the housing 10 are stops 56 against which the door 12 abuts in the open position to limit further motion in the opening direction and reduce the load on the gear assembly. A stop 58 is provided on the housing 10 to serve as an abutment for the door 12 during closing movement, and the microswitch 60 senses that the door 12 is closed and provides a signal when the door is opening. Mounted on the bracket 72 is a test button 70 which extends through an aperture in the flange 66.

Figure 3:
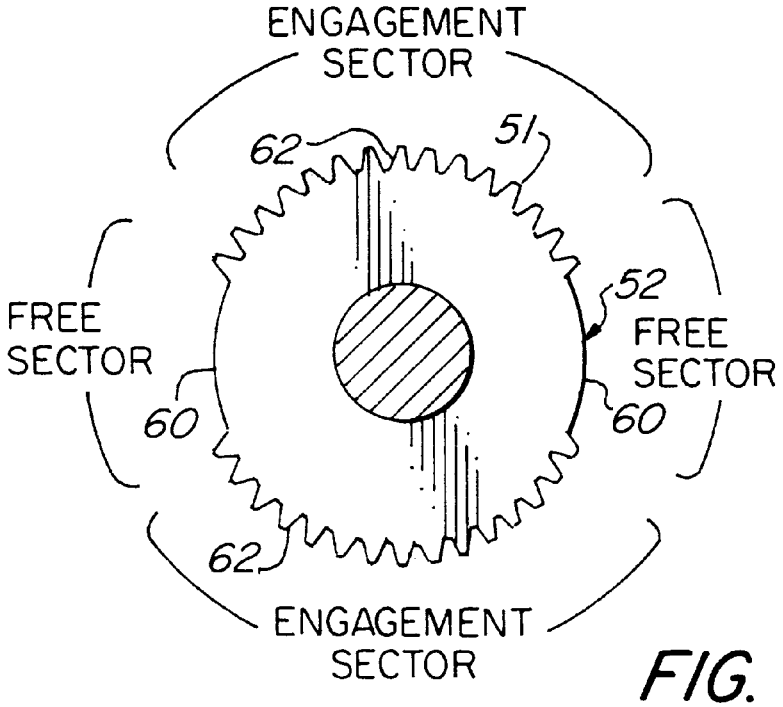
FIG. 3 is a side elevational view of the drive gear on the motor drawn to an enlarged scale.

Turning next to FIG. 3, it can be seen that the drive gear 52 on the shaft 51 of the motor 50 has a pair of diametrically opposed untoothed sectors 60 and toothed sectors 62 therebetween. When the gear 52 is rotated into a position wherein an untoothed sector 60 registers with the transfer gear 54, the latter is free to move independently to allow the door 12 to pivot downwardly into the open position by the combination of gravity and the biasing action of the springs 46.

Figure 4:
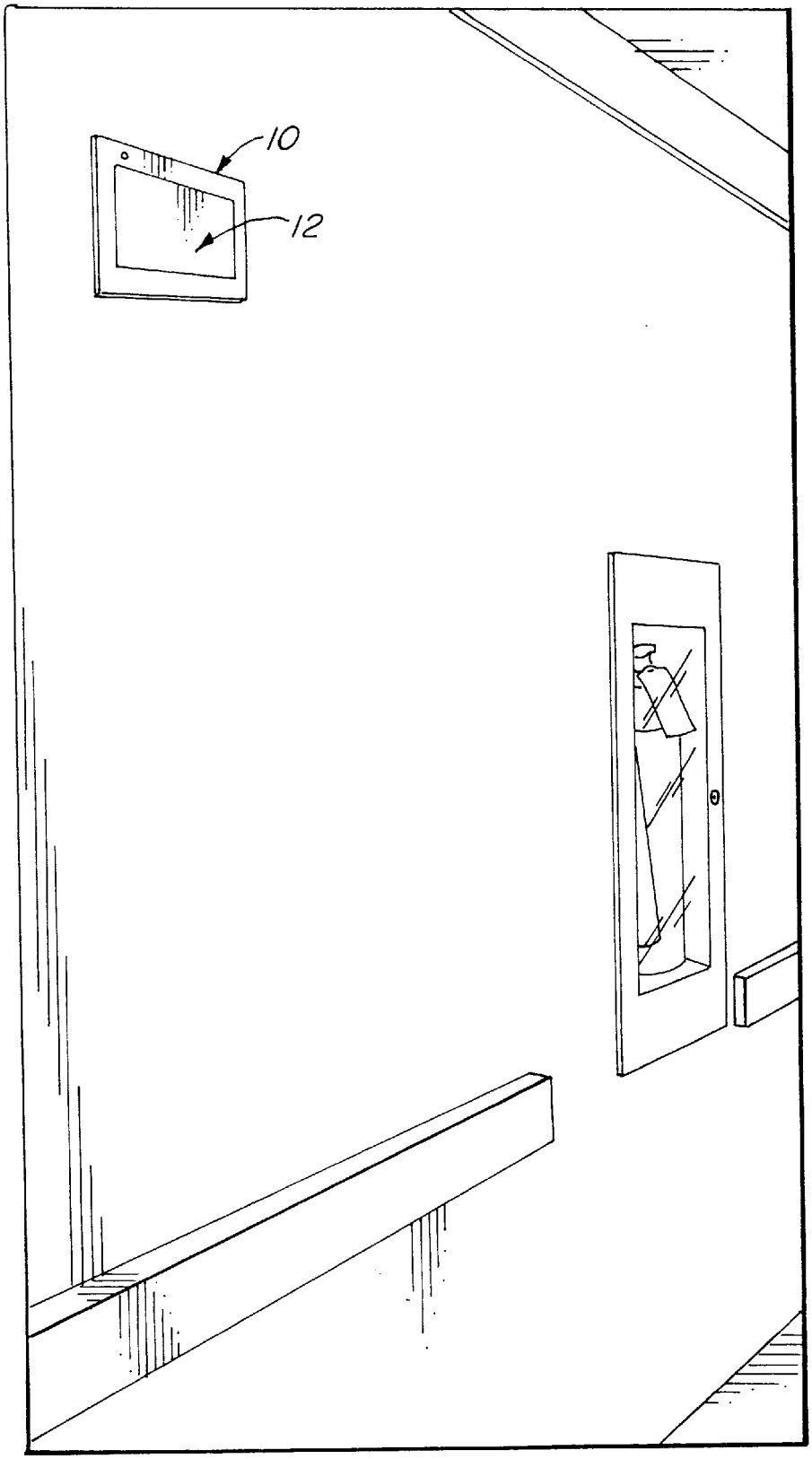
FIG. 4 is a perspective view of a lamp unit mounted in a side wall and with the door in a closed position.
Figure 5:
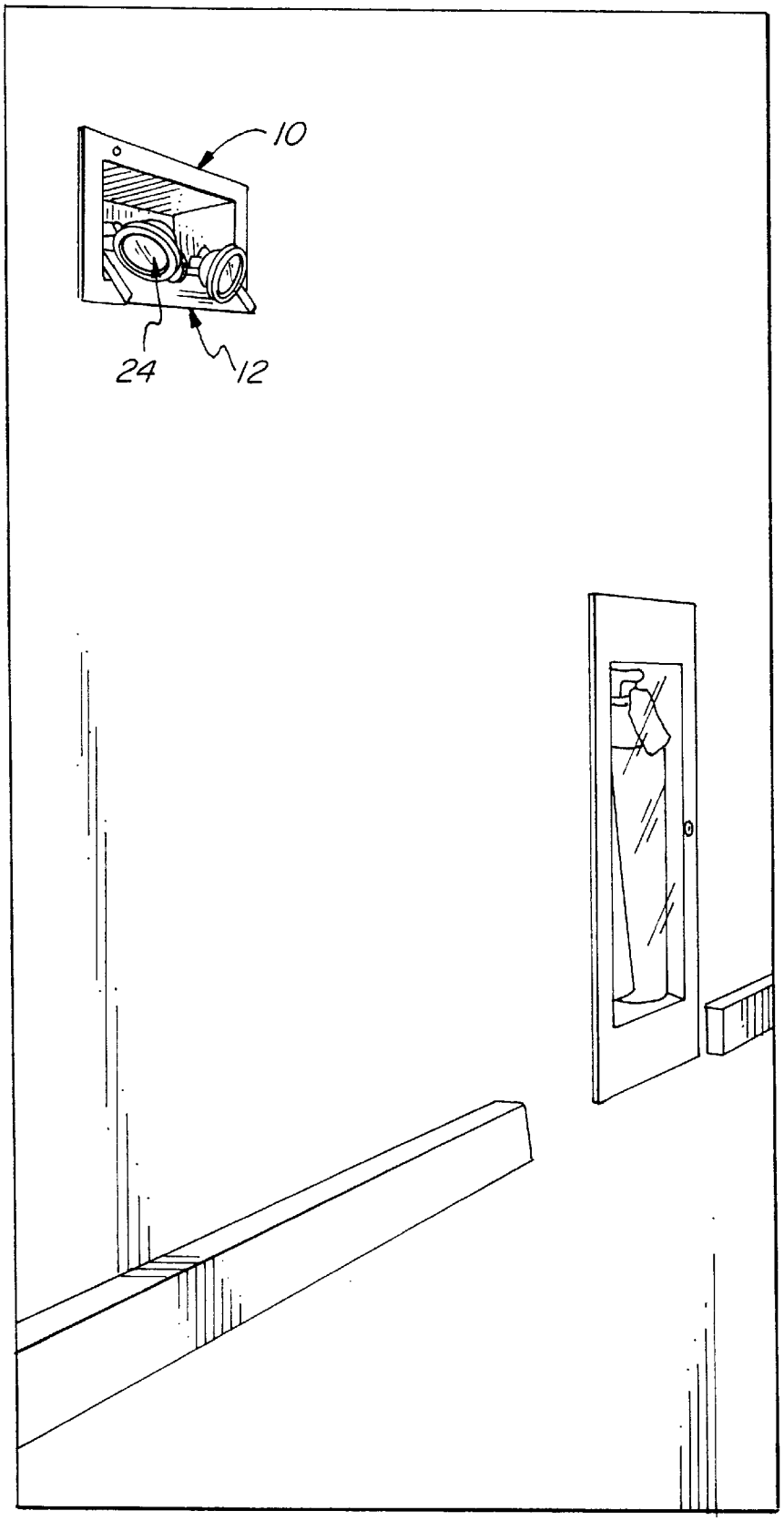
FIG. 5 is a view of the lamp unit of FIG. 5 with the door in the open position.

Turning next to FIG. 4, therein illustrated is a wall mounted lighting unit of the present invention with the door 12 in the closed position. In FIG. 5, the door 12 has moved to the open position so that the lamp units 24 will illuminate the building area thereabout.

Figure 6:
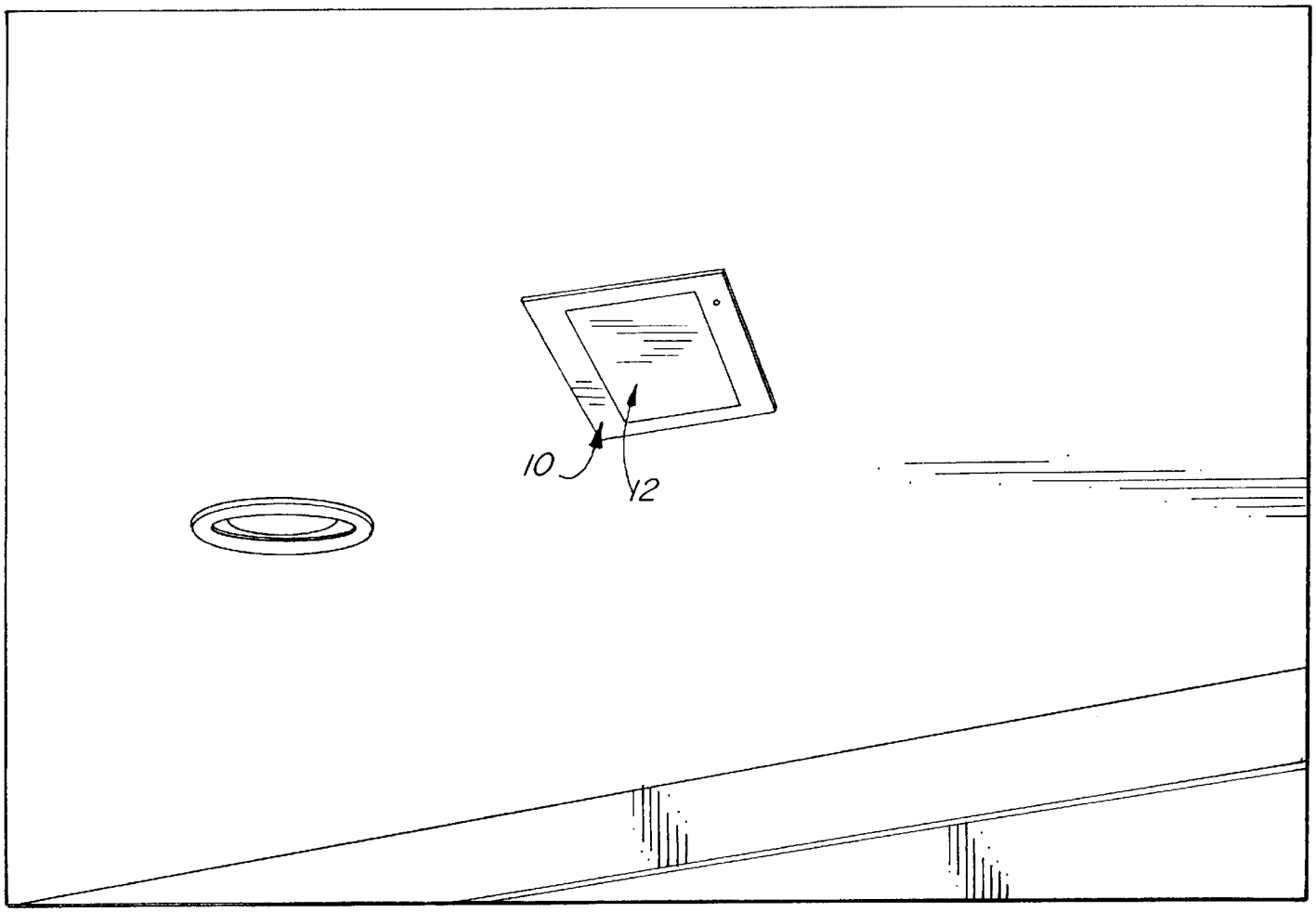
FIG. 6 is a perspective view of a lamp unit mounted in a ceiling and with the door in a closed position.
Figure 7:
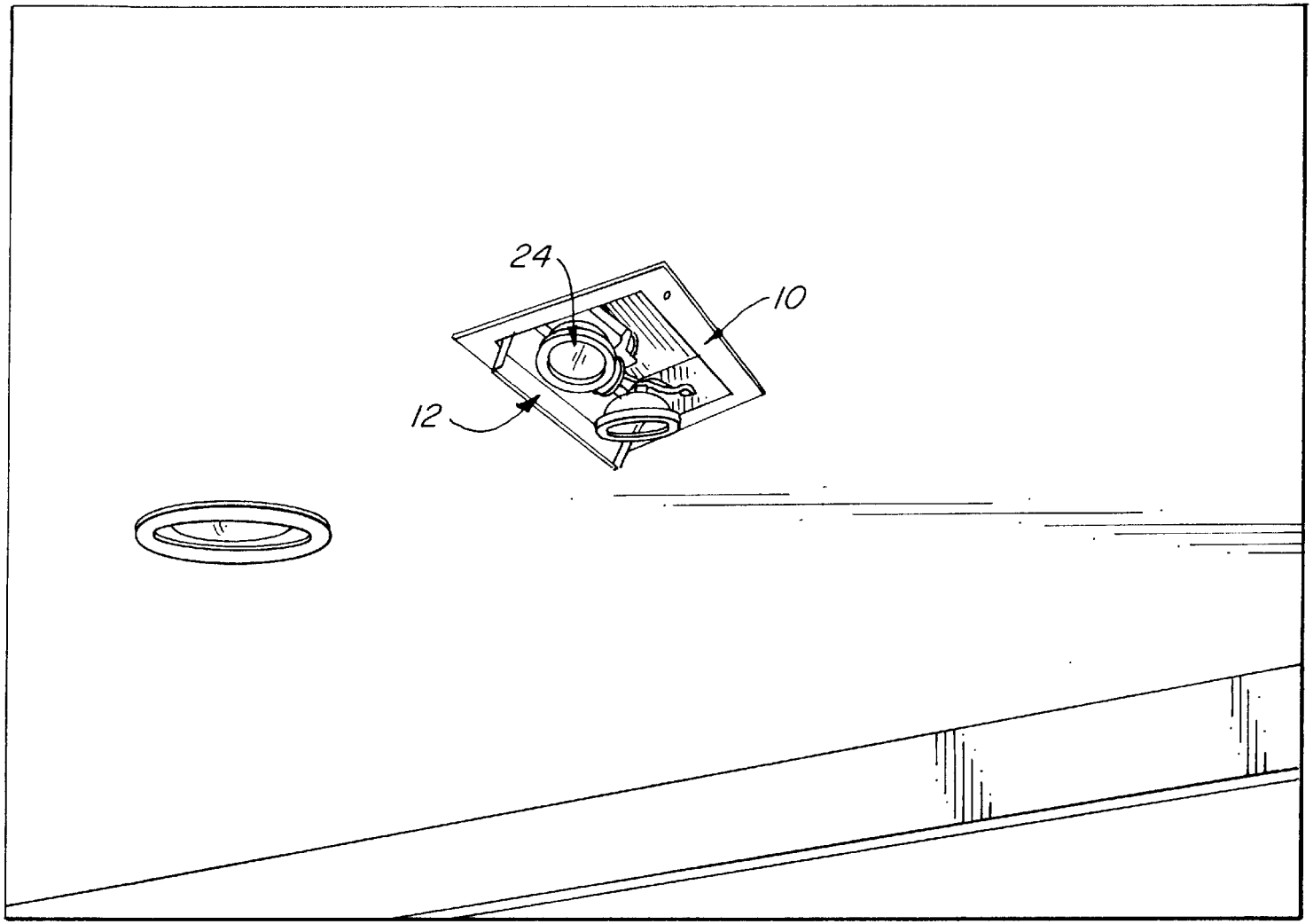
FIG. 7 is a view of the lamp unit of FIG. 6 with the door in the open position.

Similarly, FIGS. 6 and 7 illustrate the lighting unit mounted in the ceiling.

The housing 10 is mounted in a suitable recess in the ceiling or wall by fasteners (not shown) extending through mounting apertures 64 in the peripheral flange 66 on the housing 10. Conductors (not shown) providing alternating current are introduced through an aperture 68 in the back wall 70 of the housing and connected to the control board 28. If an external source of direct current is employed, an additional wire pair can be provided. If internal battery power is to be utilized, the rechargeable batteries (not shown) are mounted in the rear portion of the housing 10.

As will be readily appreciated, there are conductors (not shown) extending between the control board 28 and the motor 50, sockets 26 of the lamp unit 24 and microswitch 60, all of which utilize direct current. On the control board 28 is an inverter for converting alternating current to provide direct current to the motor during such time as that power supply is available. When standby batteries are provided in the lighting unit, the DC output charges the batteries through a charging circuit.

In operation of the unit, alternating current will flow to the control board to effect charging of batteries is self-contained battery power is employed. When the door is closed, the lamps are off and hidden within the housing since the door is essentially flush with the housing. In this condition, the motor is not energized and the drive gear is engaged with the intermediate gear by the last two teeth before reaching the free sector. This engagement of the gears also locks the door and prevents it from opening.

In the event of failure of alternating current flowing to the control board, DC current will be provided and the microswitch 60 will sense the door closed condition. The control circuit will then energize the motor which will rotate the drive gear in an attempt to move the door further inwardly. However, since the door is already against the stops, the motor will drive the driven gear which will slide on the clutch body until the drive gear moves to the untoothed sector and disengages from the intermediate transfer gear. At this point, there is nothing restraining the door from opening under gravity and the biasing spring pressure. As the door opens, the microswitch senses the opening and the lamps are energized. The control circuit later receives a signal from the microswitch that the door is open and this de-energizes the motor. At this point, the lamps are functional and illuminate the area surrounding the emergency lighting unit.

When alternating current is restored, the direct current flow is disconnected and the controller senses this condition. The motor is now energized and the drive gear rotates with the untoothed sector is passed and its other sector becomes engaged with the intermediate gear which in turn causes rotation of the driven gear. The door is now moved to its closing position. When the door reaches the closed position, the controller receives a signal from the microswitch which stops the motor and turns out the lamps.

Figure 8:
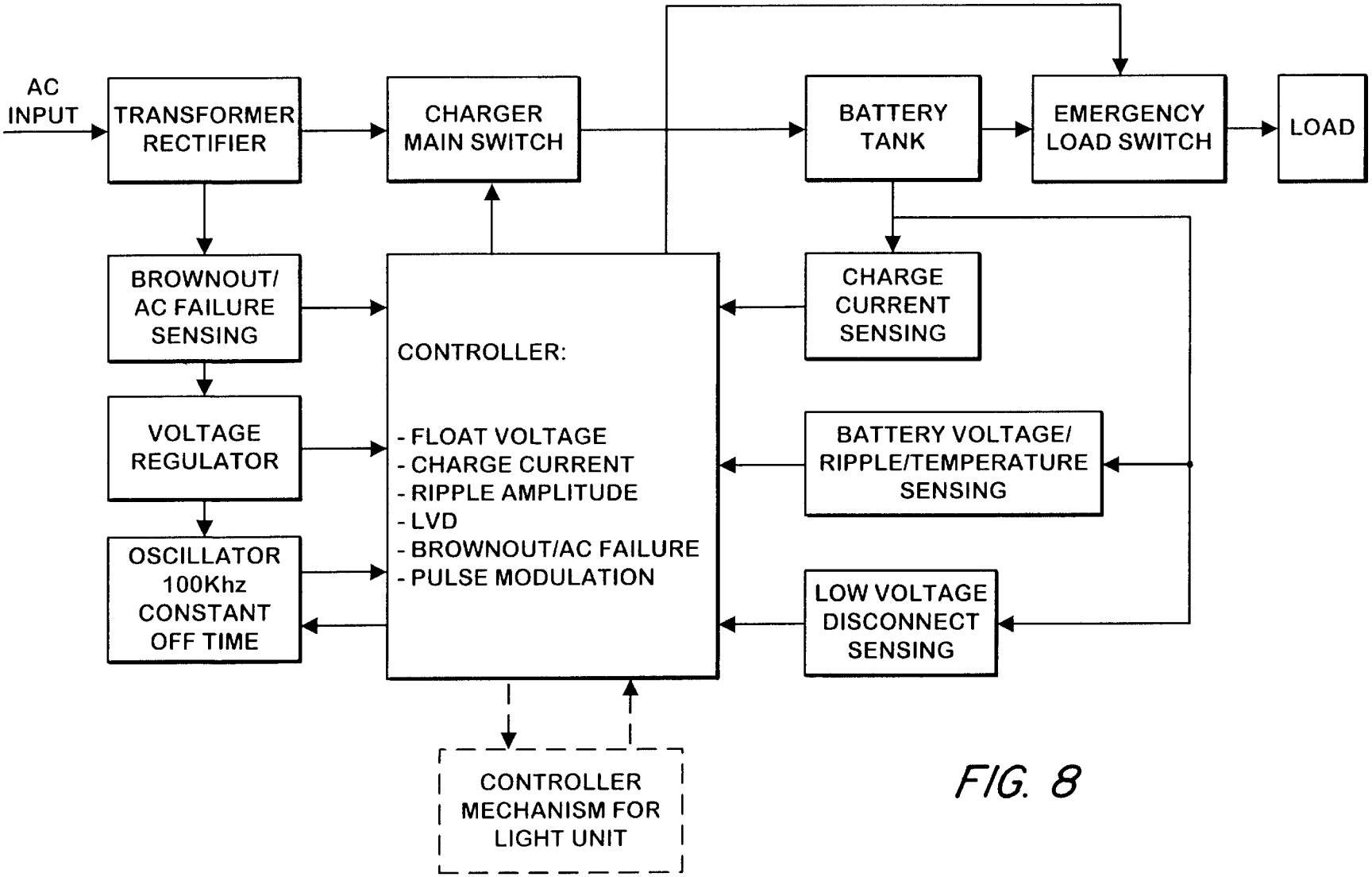
FIG. 8 is a functional block diagram of the electrical circuitry.
Figure 9A:
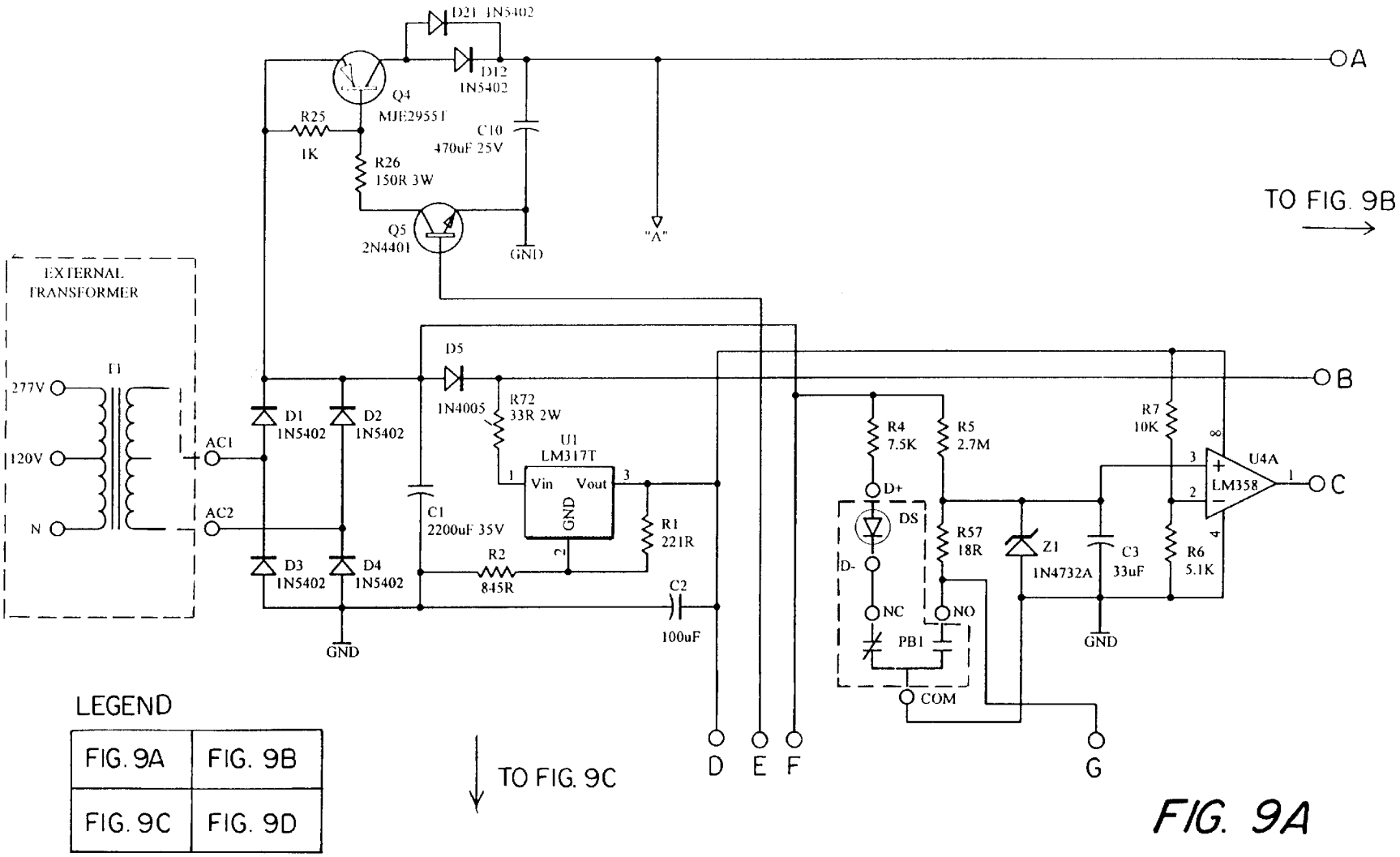
FIGS. 9*a*, 9*b*, 9*c* and 9*d* together comprise a circuit diagram for the emergency lighting unit.
Figure 9B:
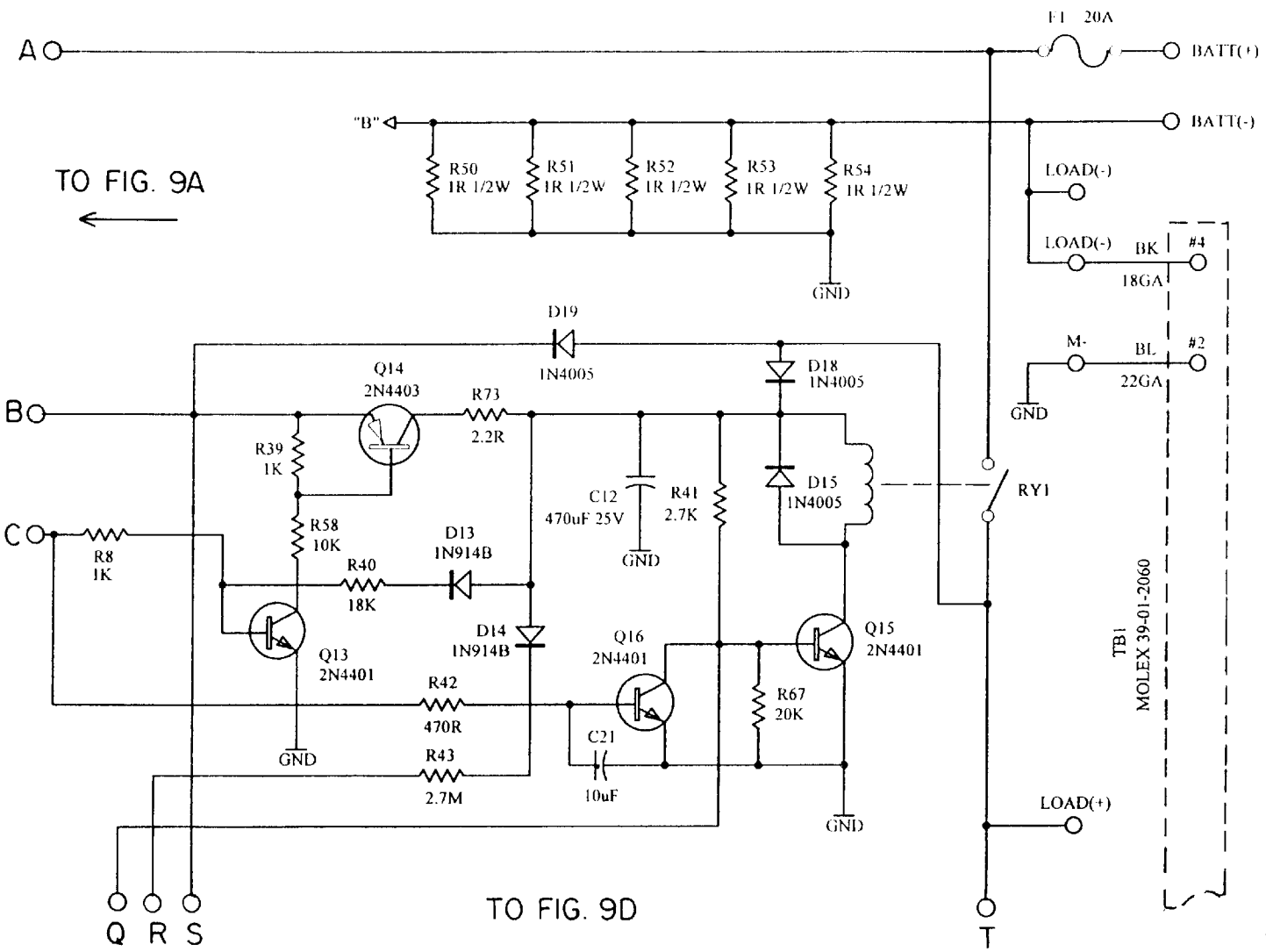
Figure 9C:
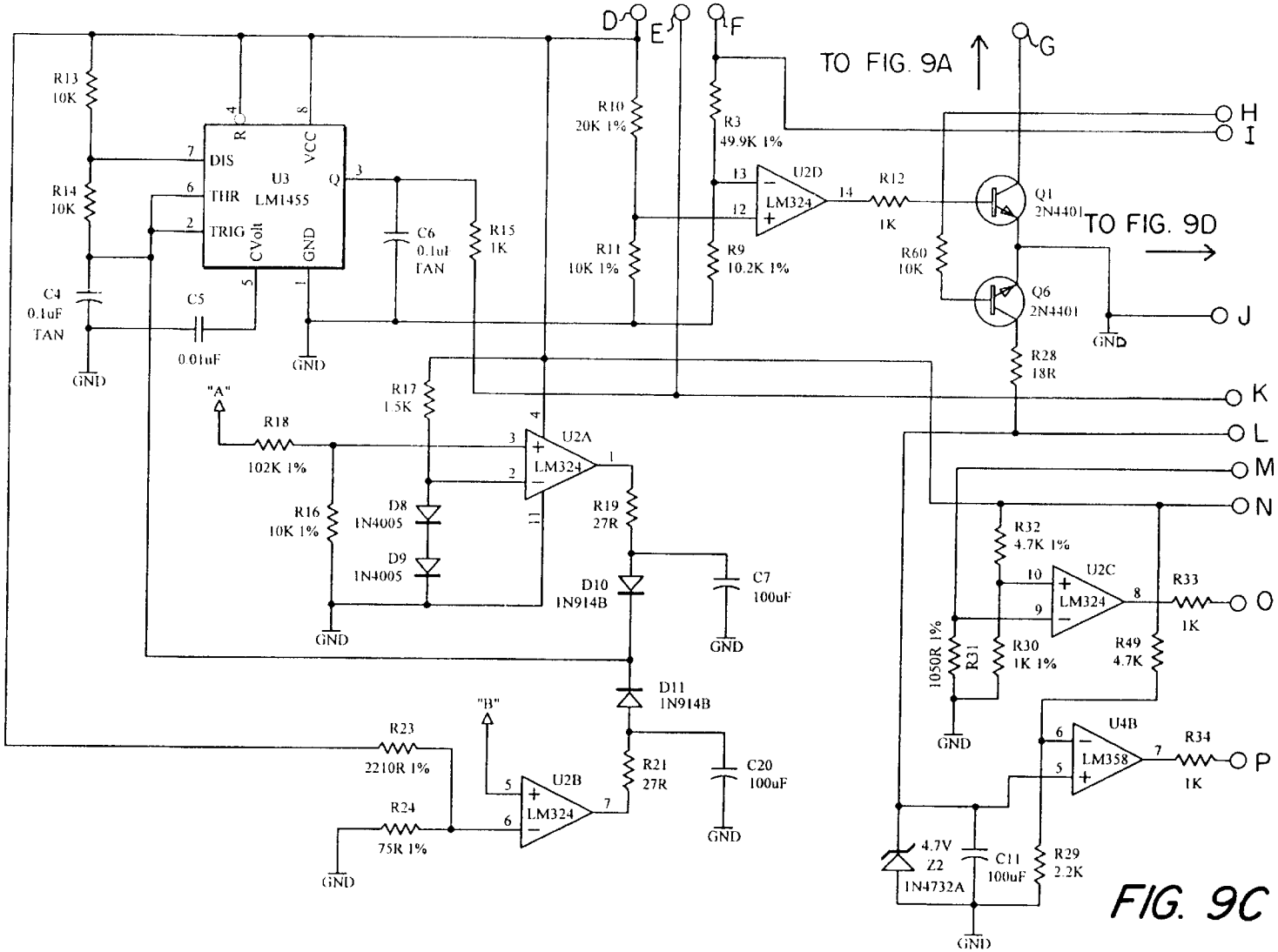
Figure 9D:
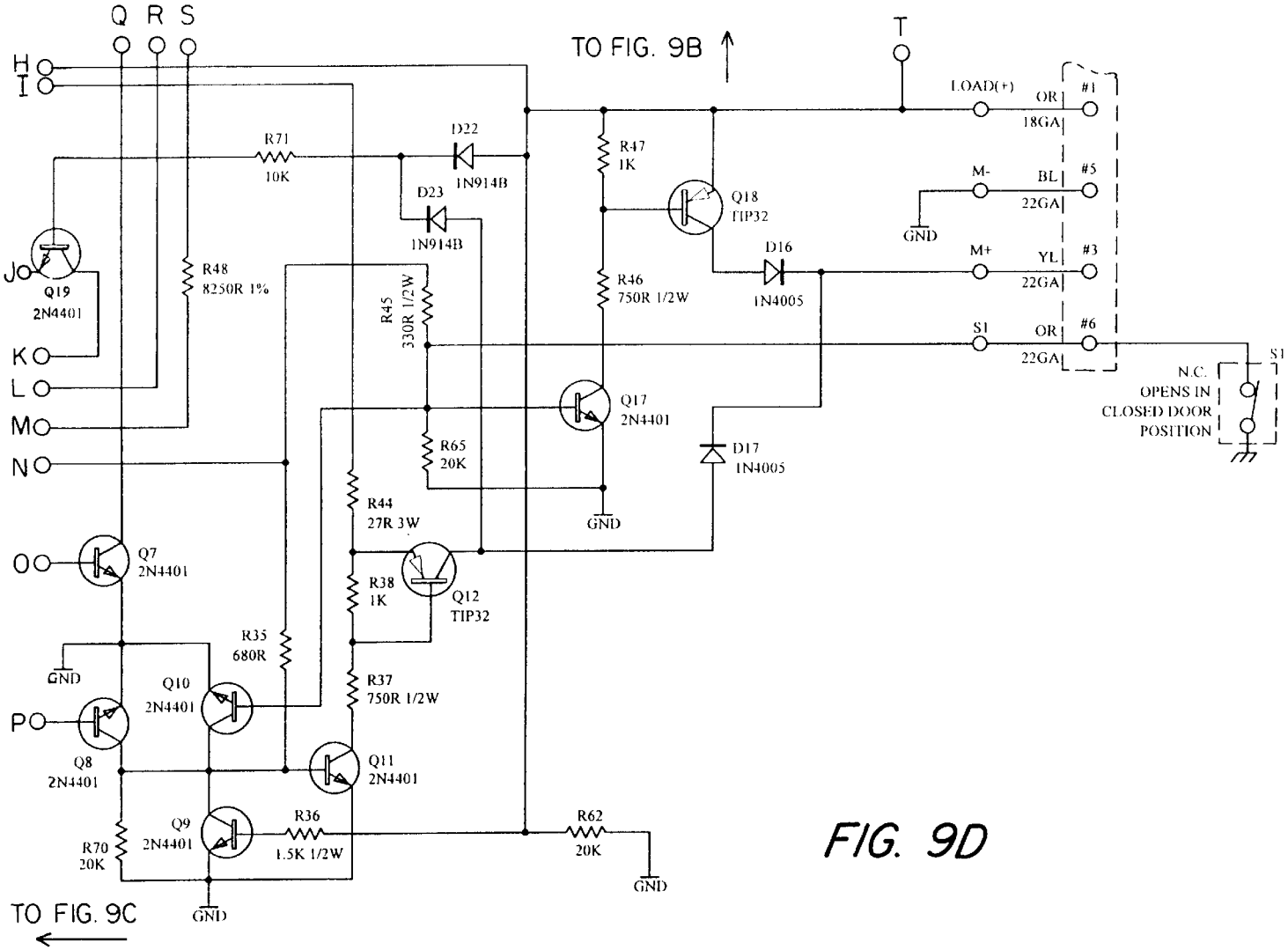

Turning next to FIG. 8, therein illustrated is a functional block diagram of the circuitry in an emergency lighting unit embodying the present invention and utilizing batteries in the housing which are maintained in a charged state by the AC power input. The AC power passes into the transformer/rectifier which produces the DC output which is utilized to charge the battery bank in the emergency lighting unit and which is also operable to drive the motor. The battery bank for DC power is utilized to operate the microswitch and also to provide the power to the electric lamps, the DC current flow to the lamps and to the microsensor is controlled by the controller and which provides such flow only in the event of a failure of AC power.

FIGS. 9*a*, 9*b*, 9*c* and 9*d* together comprise a detailed circuit diagram cell powered unit which is described by the functional block diagram of FIG. 8.

As will be readily appreciated, the emergency lighting unit of the present invention offers significant advantages in that a single unit directional motor may be utilized and a short burst of DC power is all that is required to release the engagement of the gears which permits the door to rapidly open under the force of gravity and the biasing force of the springs. This significantly reduces the opportunity for the potential for malfunction and conserves the DC power of the battery bank for operation of the lamps. The door is returned to its closed position when the AC power source is again available.

The drive assembly using the untoothed sector arrangement minimizes wear and tear in the drive assembly and the clutch prevents damage in the event that there is some obstruction preventing closing action as well as enabling the disengagement of the gear drive.

Thus, it can be seen from the foregoing detailed description and attached drawings that the emergency lighting unit of the present invention is one which can be fabricated relatively easily from all available components. The resulting assembly is simple in operation and provides a relatively long lived assembly.

Having thus described the invention, what is claimed is:

1. A drop down concealed emergency lighting unit comprising:

(a) a housing for substantially flush mounting in a recess formed in a building surface, said housing providing an opening extending in a plane to be oriented adjacent and parallel to the building surface;

(b) a door for closing said opening;

(c) means pivotally mounting one end of said door on said housing for movement relative thereto between a first closed position overlying said opening and second open position in which said door extends substantially perpendicularly to said plane of said opening;

(d) a drive assembly for moving said door between said open position and said closed position including:

(i) a direct current drive motor mounted on said housing and having an output shaft;

(ii) a drive gear mounted on said output shaft;

(iii) a driven gear mounted on said door; and (iv) means operatively engaging said drive and driven gears for movement of said door to the closed position and for maintaining said door in said closed position;

(e) a lamp unit powered by direct current; and (f) an electrical control circuit adapted to be connected to sources of alternating current and of direct current and connected to said motor and said lamp unit, said circuit including a rectifier to convert alternating current to direct current for supply to said motor, said control circuit including means for sensing the absence of alternating current and effecting disengagement of said gear operatively engaging means, to allow said door to move from said closed position to said open position, said circuit also providing power to said lamp unit upon such absence of alternating current and movement of said door to said open position, said circuit include means for sensing the restoration of alternating current and acting to effect reengagement of said gear operatively engaging means and to supply direct current to said motor to move said door to said closed position, said control circuit further acting to terminate flow of direct current to said lamp upon movement of said door to said closed position.

2. The emergency lighting unit in accordance with claim 1 wherein said gear operatively engaging means is provided by a drive gear having an untoothed sector in which said driven gear is released from engagement therewith.

3. The emergency lighting unit in accordance with claim 2 wherein said rotation of said motor to effect movement of said door to said closed position causes said drive gear to move to a position adjacent said untoothed sector at which said drive and driven gears remain engaged to retain said door in said closed position.

4. The emergency lighting unit in accordance with claim 2 wherein said drive gear has a toothed sector of a length sufficient to move said door to said closed position and an additional tooth to maintain engagement with said driven gear to retain said door in said closed position.

5. The emergency lighting unit in accordance with claim 1 wherein said drive assembly includes an intermediate gear between said drive and driven gears.

6. The emergency lighting unit in accordance with claim 2 wherein said control circuit, upon sensing the absence of alternating current, provides only a short pulse of power to said motor to effect rotation of said drive gear to the untoothed sector.

7. The emergency lighting unit in accordance with claim 1 wherein there is included biasing means acting upon said door to bias it to said open position.

8. The emergency lighting unit in accordance with claim 1 wherein said unit includes a pair of lamp units.

9. The emergency lighting unit in accordance with claim 1 wherein there is included a support shaft fixedly supported on said door and upon which said driven gear is mounted, said shaft being pivotably supported in said housing.

10. The emergency lighting unit in accordance with claim 9 wherein there is included a clutch drivingly mounted on said support shaft and through which said driven gear is drivingly engaged with said support shaft, said clutch being effective to disengage said driven gear from said support shaft in the event of forces acting upon said door to prevent said closing movement.

11. The emergency lighting unit in accordance with claim 1 wherein there is included a switch actuating by movement of said door to said open position to provide power to said lamp unit.

12. The emergency lighting unit in accordance with claim 1 wherein there is included a switch actuated upon movement of said door to said closed position to terminate operation of said motor and to discontinue flow of current to said lamp unit.

13. A drop down concealed emergency lighting unit comprising:

(a) a housing for substantially flush mounting in a recess formed in a building surface, said housing providing an opening extending in a plane to be oriented adjacent and parallel to the building surface;

(b) a door for closing said opening;

(c) means pivotally mounting one end of said door on said housing for movement relative thereto between a first closed position overlying said opening and second open position in which said door extends substantially perpendicularly to said plane of said opening;

(d) a drive assembly for moving said door between said open position and said closed position including:

(i) a direct current drive motor mounted on said housing and having an output shaft;

(ii) a drive gear mounted on said output shaft;

(iii) a driven gear mounted on said door;

(iv) an intermediate gear between said drive and driven gears;

(v) means operatively engaging said drive and driven gears for movement of said door to the closed position and for maintaining said door in said closed position, said means being provided by said drive gear having an untoothed sector in which said driven gear is released from engagement therewith;

(e) a support shaft fixedly supported on said door and upon which said driven gear is mounted, said shaft being pivotably supported in said housing.

(f) a lamp unit powered by direct current;

(g) biasing means acting upon said door to bias it to said open position; and (h) an electrical control circuit adapted to be connected to sources of alternating current and of direct current and connected to said motor and said lamp unit, said circuit including a rectifier to convert alternating current to direct current for supply to said motor, said control circuit including means for sensing the absence of alternating current and effecting disengagement of said gear operatively engaging means, to allow said door to move from said closed position to said open position, said circuit also providing power to said lamp unit upon such absence of alternating current and movement of said door to said open position, said circuit include means for sensing the restoration of alternating current and acting to effect reengagement of said gear operatively engaging means and to supply direct current to said motor to move said door to said closed position, said control circuit further acting to terminate flow of direct current to said lamp upon movement of said door to said closed position.

14. The emergency lighting unit in accordance with claim 13 wherein said rotation of said motor to effect movement of said door to said closed position causes said drive gear to move to a position adjacent said untoothed sector at which said drive and driven gears remain engaged to retain said door in said closed position.

15. The emergency lighting unit in accordance with claim 13 wherein said drive gear has a toothed sector of a length sufficient to move said door to said closed position and an additional tooth to maintain engagement with said driven gear to retain said door in said closed position.

16. The emergency lighting unit in accordance with claim 13 wherein said control circuit, upon sensing the absence of alternating current, provides only a short pulse of power to said motor to effect rotation of said drive gear to the untoothed sector.

17. The emergency lighting unit in accordance with claim 13 wherein there is included a clutch drivingly mounted on said support shaft and through which said driven gear is drivingly engaged with said support shaft, said clutch being effective to disengage said driven gear from said support shaft in the event of forces acting upon said door to prevent said closing movement.

18. The emergency lighting unit in accordance with claim 13 wherein there is included a switch actuating by movement of said door to said open position to provide power to said lamp unit, and a switch actuated upon movement of said door to said closed position to terminate operation of said motor and to discontinue flow of current to said lamp unit.

* * * * *